US007373766B1

(12) United States Patent
Watkins

(10) Patent No.: US 7,373,766 B1
(45) Date of Patent: May 20, 2008

(54) BITLESS BRIDLE

(76) Inventor: L. Dale Watkins, 4785 S. 1174 West, Taylorsville, UT (US) 84123

( * ) Notice: Subject to any disclaimer, the term of this patent is extended or adjusted under 35 U.S.C. 154(b) by 282 days.

(21) Appl. No.: 11/237,048

(22) Filed: Sep. 27, 2005

Related U.S. Application Data

(63) Continuation-in-part of application No. 11/142,813, filed on May 31, 2005, now abandoned.

(51) Int. Cl.
*B68B 1/04* (2006.01)

(52) U.S. Cl. ..... 54/6.1

(58) Field of Classification Search ..... 54/6.1, 54/6.2, 7, 24

See application file for complete search history.

(56) References Cited

U.S. PATENT DOCUMENTS

| | | | | |
|---|---|---|---|---|
| 229,405 | A | | 6/1880 | Hartman |
| 952,610 | A | | 3/1910 | Daly et al. |
| 987,420 | A | | 3/1911 | Wilson |
| 1,116,691 | A | | 11/1914 | Gradberg |
| 1,148,096 | A | | 7/1915 | Klabo |
| 1,333,474 | A | | 3/1920 | De France |
| 1,478,958 | A | | 12/1923 | Heien |
| 1,530,450 | A | | 3/1925 | White |
| 1,653,382 | A | | 12/1927 | Wiesenfeld |
| 2,186,350 | A | | 1/1940 | Simon |
| 2,342,449 | A | | 2/1944 | Burgess |
| 2,469,046 | A | | 5/1949 | Laws |
| 2,471,121 | A | | 5/1949 | Reed, Jr. |
| 2,931,154 | A | | 4/1960 | Sauter |
| 3,263,399 | A | | 8/1966 | Faragher |
| 3,458,971 | A | | 8/1969 | Stern et al. |
| 3,604,183 | A | | 9/1971 | Iseli |
| 3,657,863 | A | | 4/1972 | Blair |
| 3,998,033 | A | | 12/1976 | Watkins et al. |
| 4,132,054 | A | * | 1/1979 | Mader ..... 54/6.1 |
| 4,798,043 | A | | 1/1989 | Wyse |
| 5,966,911 | A | | 10/1999 | Gray et al. |
| 6,058,686 | A | | 5/2000 | Wheeler |
| 6,178,652 | B1 | | 1/2001 | Foster |

(Continued)

FOREIGN PATENT DOCUMENTS

NR 30553 3/1919

*Primary Examiner*—Rob Swiatek
(74) *Attorney, Agent, or Firm*—Thorpe North & Western LLP

(57) ABSTRACT

A bitless bridle for horses includes a pair of substantially rigid sidepieces, each including a shaft and at least four attachment eyelets associated therewith. The at least four attachment eyelets each include a single, end eyelet extending longitudinally from a lowermost end of the sidepiece and three eyelets grouped about an opposite end of the sidepiece in a cloverleaf configuration. One of the three eyelets is a chinband eyelet configured to be coupled to a chinband of the bridle. Supporting headgear is coupled to the pair of substantially rigid sidepieces and is configured to maintain the sidepieces in position on sides of the head of the horse. An enhancing link is coupled between the end eyelet and the chinband. The enhancing link has at least one enhancing eyelet associated therewith and located intermediate the end eyelet and the chinband. The enhancing eyelet is configured to provide at least one intermediate point of attachment for a rein between the end eyelet and the chinband to allow a wielder of the rein to apply leverage through the sidepiece with the rein.

13 Claims, 1 Drawing Sheet

U.S. PATENT DOCUMENTS 6,508,203 B2 1/2003 Williams
6,553,747 B1 4/2003 Texel
6,591,589 B2 7/2003 Cook
6,643,999 B1 11/2003 Wheat
6,662,536 B2 12/2003 Belton et al.
6,691,497 B1 2/2004 Rodgers
6,705,064 B1 3/2004 Grissom

* cited by examiner

BITLESS BRIDLE

This application is a continuation-in-part of copending U.S. patent application Ser. No. 11/142,813, filed May 31, 2005, now abandoned which is hereby incorporated herein by reference.

FIELD OF THE INVENTION

The present invention relates generally to bridles used in riding and training horses. More particularly, the present invention relates to such bridles that do not require the use of a bit in the horse's mouth; e.g., to "bitless" bridles.

BACKGROUND OF THE INVENTION

There are many situations in which the use of the conventional bit-type bridle can be highly disadvantageous. Many horses tend to chew the bit, develop sores within their mouths, balk at the bit so that excessive pressure must be applied in order to obtain control, salivate excessively when the bit is in their mouth, or, in untrained and unbroken horses, misbehave and rear their heads so that the bit cannot be placed into their mouths. It is also known that a bit in a horse's mouth can cause cutting of the tongue, chipping of the teeth, bruising of the mouth, etc.

For at least these reasons the hackamore-type bridle is often used to break horses or is used on horses that have mouth problems that limit use of a bit. Hackamore bridles generally have rigid sidepieces wherein applying pressure to the reins will result in a pivoting action. The sidepieces are usually constructed such that an actual pivoting around a pivotal point takes place. These forces are used to train or direct a horse to act or move in a particular manner or direction. These bridles can be disadvantageous in that they generally apply pressure only to the nose and/or under the chin of the horse when there are other areas which are as sensitive and which also can aid in the control of the horse's actions.

One of the more effective bitless hackamore-type bridles developed to date is disclosed in U.S. Pat. No. 3,998,033 (hereinafter referred to as the '033 bridle"), to the present inventor. The '033 bridle has sidepieces whereby pressure upon the reins is transmitted by the sidepieces to multiple points on the horses head. The sidepieces of the '033 bridle operate by pivotal means that do not require moving parts and which will, when pressure is applied to the reins, manually exert pressure to the horse at the top of the head behind the horse's ears, over the front of the horse's nose, under the chin and inwardly on the sides of the jaw of the horse.

Despite the popularity of the '033 bridle, it has been found that it can be problematic in a number of manners. In general, the reins used with the '033 bridle are connected at the lowermost point of each sidepiece, near the mouth of the horse. Thus, a great deal of leverage can be applied through each of the sidepieces of the '033 bridle with a pull on the reins. While a large amount of leverage may be desirable in some applications, such as with a very unruly horse, more well-trained horses often require less force applied to the face or head of the horse to achieve desired results.

SUMMARY OF THE INVENTION

It has been recognized that it would be advantageous to develop a bitless bridle that allows variability in the leverage applied through the sidepieces depending upon an attachment location of one or more reins to the bridle.

The invention provides a bitless bridle for horses, including a pair of substantially rigid sidepieces, each including a shaft and at least four attachment eyelets associated therewith. The at least four attachment eyelets can include a single, end eyelet extending longitudinally from a lowermost end of the sidepiece, and three eyelets grouped about an opposite end of the sidepiece in a cloverleaf configuration, one of the three eyelets being a chinband eyelet configured to be coupled to a chinband of the bridle. Supporting headgear can be coupled to the pair of substantially rigid sidepieces and can be configured to maintain the sidepieces in position on sides of the head of the horse. An enhancing link can be coupled between the end eyelet and the chinband at some distance from center and out to the eyelet of each of the pair of sidepieces. The enhancing link can have at least one enhancing eyelet associated therewith and located intermediate the end eyelet and the chinband. The enhancing eyelet can be configured to provide at least one intermediate point of attachment for a rein between the end eyelet and the chinband to allow a wielder of the rein to apply leverage through the sidepiece with the rein.

In accordance with another aspect of the invention, a bitless bridle for horses is provided, including a pair of substantially rigid sidepieces, each including a shaft and at least five attachment eyelets associated therewith. The at least five attachment eyelets can include a single, end eyelet extending longitudinally from a lowermost end of the sidepiece; three eyelets grouped about an opposite end of the sidepiece in a cloverleaf configuration, one of the three eyelets being a chinband eyelet configured to be coupled to a chinband of the bridle; and an enhancing eyelet disposed intermediate the end eyelet and chinband eyelet. The enhancing eyelet can be configured to provide at least one intermediate point of attachment for a rein between the end eyelet and the chinband eyelet to allow a wielder of the rein to apply leverage through the sidepiece with the rein. Supporting headgear can be coupled to the pair of substantially rigid sidepieces and can be configured to maintain the sidepieces in position on sides of the head of the horse.

In accordance with another aspect of the invention, a method for directing a horse is provided, including step of installing on a head of the horse a bitless bridle. The bitless bridle can include a pair of substantially rigid sidepieces, each including a shaft and at least five attachment eyelets associated therewith. The at least five attachment eyelets can include a single, end eyelet extending longitudinally from a lowermost end of the sidepiece; three eyelets grouped about an opposite end of the sidepiece in a cloverleaf configuration, one of the three eyelets being a chinband eyelet configured to be coupled to a chinband of the bridle; and an enhancing eyelet disposed intermediate the end eyelet and the chinband. The method can include the step of selecting, based on a degree of leverage desired to be applied to one of the sidepieces, one of: the end eyelet, the enhancing eyelet, and the chinband eyelet of the sidepiece; and coupling a rein to and applying a force to the eyelet selected to provide direction to the horse.

Additional features and advantages of the invention will be apparent from the detailed description which follows, taken in conjunction with the accompanying drawings, which together illustrate, by way of example, features of the invention.

DETAILED DESCRIPTION OF THE INVENTION

Figure 1:
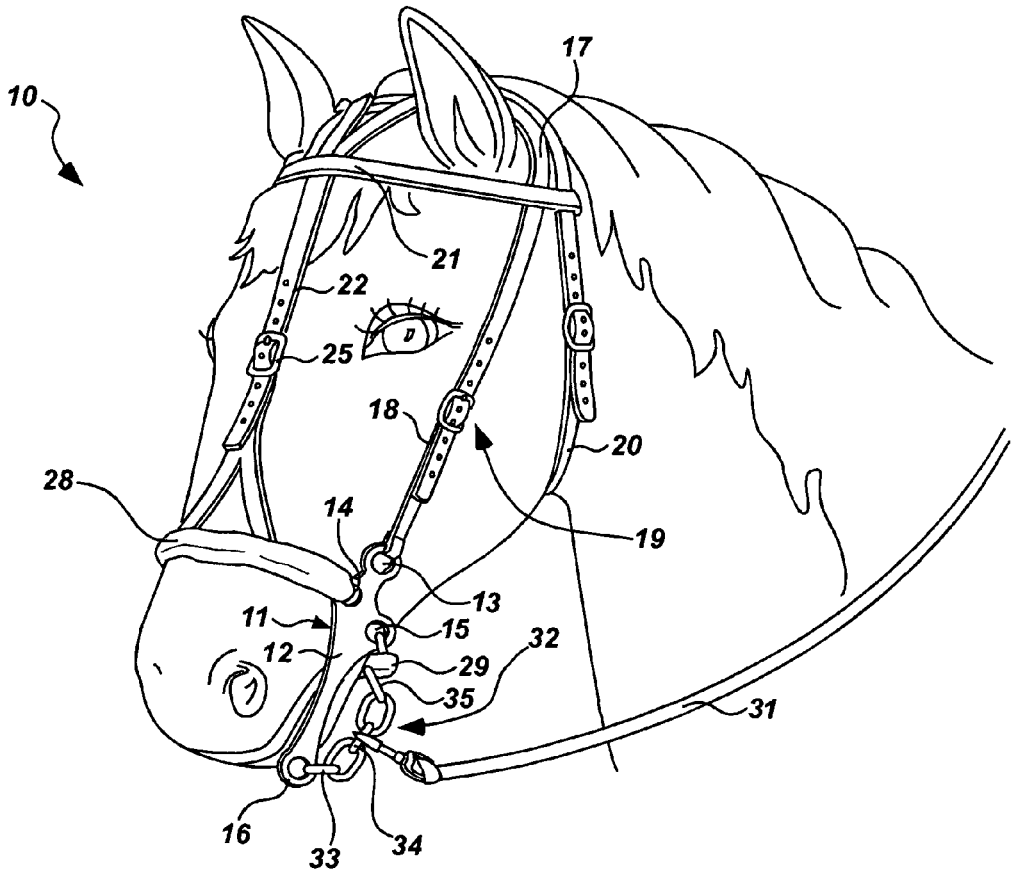
FIG. 1 is a perspective view of a bitless bridle in accordance with an embodiment of the present invention, shown in an exemplary installation over a horse's head.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention. The following detailed description and exemplary embodiments of the invention will be best understood by reference to the accompanying drawings, wherein the elements and features of the invention are designated by numerals throughout.

The present invention is directed to a bitless bridle for use in training, leading or riding a horse. The bridle of the present invention shares some common components of the bridle disclosed in U.S. Pat. No. 3,998,033, issued to the present inventor, which is hereby incorporated herein by reference in its entirety. In general, such bitless bridles operate to allow a rider, trainer or guider of a horse to direct or manipulate the horse by applying pressure to the bridle through one or more reins or training ropes and/or snaps and knots attached to the bridle. As the bridle does not require the presence of a bit, damage to the horse's mouth, tongue, teeth, etc. is reduced or avoided.

The bitless bridle described herein is used much like a conventional hackamore bridle except that the combination of the cloverleaf gives added leverage power so that a light pull on the reins applies, at substantially the same time: i) pressure on the nose, ii) under the chin and iii) behind the ears of the horse, and also iv) torques or twists the sidepieces and noseband inwardly into the side of the jaws of the horse. The utilization of all four of these pressure points negates the requirement of having a bit in the horse's mouth that can cut the tongue or chip the teeth of the horse, or cause other common bruises and cuts.

FIG. 1 illustrates an exemplary embodiment of a bitless bridle 10 in accordance with an embodiment of the invention in which a substantially rigid "cloverleaf" sidepiece 11 generally includes a body shaft 12. The body shaft 12 can take a variety forms and is shown in the FIGURE as generally rectangular in cross section, with two opposing, flat faces, one of which is generally exposed toward the horse's face and the other of which is generally exposed away from the horse's face. While the shape of the body shaft shown provides an aesthetically pleasing appearance, the body shaft can vary in shape and can include, for example, a cylindrical cross section, square cross section, octagonal cross section, etc. The sidepiece can include an end eyelet 16 that extends longitudinally from the body shaft at a lowermost end of the body shaft adjacent the horse's mouth. Three eyelets 13, 14 and 15 can be grouped about an opposite end of the sidepiece in a cloverleaf configuration. The eyelets at the opposite end of the sidepiece can include an upper eyelet 13, a noseband eyelet 14, and a chinband eyelet 15. The end eyelet 16, upper eyelet 13, noseband eyelet 14 and chinband eyelet 15 generally extend perpendicularly from the shaft and in the same plane as the shaft. The noseband eyelet is generally located just slightly closer to the upper eyelet than is the chinband eyelet. The sidepiece is generally referred to herein as a "cloverleaf" sidepiece due to its similarity in appearance to a cloverleaf.

The bridle 10 can include a pair of sidepieces 11, only one of which is fully shown in the FIGURE, which, in operation, are each disposed on opposing sides of the horse's face. The sidepieces are mounted to a supporting headgear assembly, which can include, but is not limited to, an adjustable throatlatch 20, a headstall 17 terminating in cheekstraps 18, and a browband 21 terminating in passageways at each end through which the throatstrap and headstall pass. An adjustable centerpiece 22 can have passageways in one end through which the headstall and throatlatch can pass and extend through an opening in the browband.

The centerpiece 22 can be attached at a lower end to noseband 28. The upper eyelet 13 of the cloverleaf sidepiece 11 can be attached to the adjustable cheekstrap 18 on either side of the bridle in such a manner that the noseband eyelet 14 is in an upright position. The noseband can be fixedly attached to the noseband eyelet on each sidepiece and the chinband eyelet 15 can be attached to chinband 29. The sidepieces can be of such a length that each of the upper, noseband and chinband eyelets of each sidepiece are located slightly above the end of the horse's mouth. The sidepiece shown in the FIGURE is approximately 9 inches in length, however, it is to be understood that the length of the sidepieces can vary from 6 inches to 12 inches and greater. It is to be understood that the dimensions (e.g., width, thickness and length) of the sidepiece shown in the figures does not, in any way, limit the scope of the invention.

The headstall 17 can extend over the head of the horse behind the ears and can terminate in adjustable cheekstraps 18 having adjustable means 19. The throatlatch 20 can be looped around the neck and throat of the horse and can also include an adjustable attachment. The browband 21 can include passageways in either end thereof through which the throatlatch and the cheekpieces pass. The centerpiece 22 can also pass through the browband in the center portion thereof. The centerpiece can be adjustable via adjustment buckle or hook 25. Noseband 28 and chinband 29 can be formed from a variety of materials, including rope or, in one embodiment, chain covered by velvet or other fabric.

In attaching the cloverleaf bitless bridle to the horse, the centerpiece 22 and cheekstraps 18 can be adjusted so that the noseband 28 fits snugly over the horse's nose and does not hang loose and droop down on the horse's nostrils. The cloverleaf sidepieces 11 tend to pull toward each other at the lower ends and can nearly touch each other when proper adjustment has been made.

In one embodiment of the invention, the bridle 10 includes an enhancing link 32 coupled between the end eyelet 16 and the chinband of each of the pair of sidepieces 11. The enhancing link can have at least one enhancing eyelet 34 associated therewith that can be located intermediate the end eyelet and the chinband eyelet. The enhancing eyelet can be configured to provide at least one intermediate point of attachment for rein 31 between the end eyelet and the chinband eyelet to allow a wielder of the rein to apply leverage through the sidepiece with the rein.

The enhancing link 32 provides a number of advantages over conventional bitless bridles in. To appreciate these advantages, it is thought proper to briefly explore the action of the sidepieces 11 when force is applied to various points of the sidepieces. For example, if a rein 31 is attached to the sidepiece at end eyelet 16, force applied through the rein generally results in leveraging the sidepiece perpendicularly to an axis running longitudinally along the length of the sidepiece and acting in a first class leverage (similar to the force generated by a claw hammer pulling on a nail). In the extreme case, the end of the side piece adjacent eyelet 16 is lifted away from the horse and the sidepiece pivots about upper eyelet 13 (subject to restraining forces applied or created by the headgear assembly). As this configuration generally provides the most first class leverage through the sidepiece, it is the most aggressive manner in which to couple the reins to the bridle. Once so attached, even relatively small forces applied to the reins can result in significant forces being applied to the horse's face or head.

In contrast, if a rein 31 is coupled to the sidepiece 11 at the chinband, a pulling force applied through the rein generally results in leveraging the sidepiece about the longitudinal axis of the sidepiece, causing the sidepiece to "roll" and pivot about a portion of noseband eyelet 14 that is in contact with the horse's face, causing a torque pressure. This configuration generally allows a rider to more easily apply "lateral reining" to the horse to turn the horse. As this configuration generally provides the least first class leverage through the sidepiece (coupled with the most leveraged torque pressure), it is the most leverage in which to force lateral reining of the horse. In this case, relatively small forces applied to the reins may result in quite high lateral reining leverage force being applied to the horse's face or head.

By providing a means for varying a position between the end eyelet 16 and the chinband eyelet 15 at which the rein is coupled to (and thus applies force to) the sidepiece, the magnitude and type of forces applied to the horse's face and head can be varied. When installed on a horse, a rider or trainer can alter the stimuli provided to a horse by the bridle by altering a position at which the reins are coupled to the bridle. In the case where a horse is particularly unruly, or is in an environment in which the horse is not comfortable, the rider or trainer may connect the reins to a location on the enhancing link 32 that is close to the end eyelet 16 such that the bridle provides the most aggressive first class leverage and only slight torque pressure force to the horse's head or face. In the case where the horse is well-trained, and/or is in a comfortable environment, the horse may need very little direction from the rider or trainer, and the reins can be coupled to the enhancing link in a location that is halfway from the chinband. In many cases, it may be most appropriate to couple the reins to a location that is intermediate the upper and end eyelets, for example, at enhancing link 34. It has been found that the enhancing link 34 provides a good balance between the extremes of first class leverage and torque leverage coupling of the reins to either the end eyelet or the upper eyelet.

In the aspect of the invention shown in the FIGURE, the enhancing link 32 includes 5 interengaged chain links that include the enhancing eyelet 34, and a neck reining eyelet 33 and a lateral reining eyelet 35. It is generally the case that attaching rein 31 to the neck reining eyelet 33 provides a more aggressive reining response and high first class leverage while attaching the rein to the lateral reining eyelet 35 provides a more aggressive torque reining response.

The enhancing link 32 can take a variety of forms, and in one embodiment can be formed at least partially of a substantially flexible material, such as rope or interengaged chain links. In the case where the enhancing link is formed of interengaged links, at least five interengaged links can be associated therewith. In this manner, the five interengaged links can be configured to provide five intermediate points of attachment for the rein. In the embodiment shown, the enhancing eyelet 34 is substantially centered lengthwise along the enhancing link. However, the invention is not so limited and the enhancing eyelet can be located at a variety of locations intermediate the end eyelet 16 and the chinband eyelet 15.

In one aspect of the invention (not shown), the enhancing eyelet can be substantially rigidly attached to the sidepiece intermediate the end eyelet 16 and the chinband eyelet 15. In this embodiment, the bridle need not include an enhancing link but can still provide a manner of coupling the reins to a location intermediate the end eyelet and chinband eyelet to allow a rider or trainer to alter the magnitude and character of the force applied by the sidepiece through the reins.

The enhancing link 32 is generally coupled between the end eyelet 16 and the chinband. In the aspect of the invention shown, the enhancing link is indirectly coupled between these two eyelets, in that a lower end of the enhancing link is coupled directly to the end eyelet while an upper end of the enhancing link is coupled to the chinband 29, which is coupled to the chinband eyelet 15. In this manner, force applied through reins 31 can be at least partially transmitted through the chinband as well as through the sidepiece 11. In another aspect of the invention (not shown), the upper end of the enhancing link can be coupled directly to the chinband eyelet 15.

The cloverleaf sidepiece is novel in that it will rotate about an imaginary axis located on the sidepiece at a point approximately between the areas where the oppositely extending noseband eyelet 14 and chinband eyelet 15 are connected to the sidepiece 11. Rotation about this axis is unique in that it causes pressure to be applied to at least four points on the horse's head, i.e., behind the ears, over the nose, under the chin and inwardly on the jaws. Each of these forces can be varied in magnitude with regard to a common force on the reins by attaching the reins at different points along the enhancing link 32. The present invention thus provides advantages over conventional devices by allowing training and riding procedures to be varied from horse to horse, or from one environment to another when used with one horse.

In addition to the structure discussed above, the present invention also provides a method for directing a horse, including the step of installing on a head of the horse a bitless bridle. The bitless bridle can include a pair of substantially rigid sidepieces, each including a shaft and at least five attachment eyelets associated therewith, the at least five attachment eyelets including: a single, end eyelet extending longitudinally from a lowermost end of the sidepiece; three eyelets grouped about an opposite end of the sidepiece in a cloverleaf configuration, one of the three eyelets being a chinband eyelet configured to be coupled to a chinband of the bridle; and an enhancing eyelet disposed intermediate the end eyelet and the chinband eyelet. The method can include the steps of: selecting, based on a degree of leverage desired to be applied to one of the sidepieces, one of the end eyelet, the enhancing eyelet, and the chinband eyelet of the sidepiece; and coupling a rein to and applying a force to the eyelet selected to provide direction to the horse, at the same time a training rope of lead rope can be attached to the center eyelet of the chinband for tying or training of the horse.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A bitless bridle for horses, comprising:

a pair of substantially rigid sidepieces, each including a shaft and at least four attachment eyelets associated therewith, the at least four attachment eyelets including:

a single, end eyelet extending longitudinally from a lowermost end of the sidepiece; and three eyelets grouped about an opposite end of the sidepiece in a cloverleaf configuration, one of the three eyelets being a chinband eyelet configured to be coupled to a chinband of the bridle;

supporting headgear coupled to the pair of substantially rigid sidepieces and being configured to maintain the sidepieces in position on sides of the head of the horse; and an enhancing link coupled between the end eyelet and the chinband, the enhancing link having at least one enhancing eyelet associated therewith and located intermediate the end eyelet and the chinband, the enhancing eyelet being configured to provide at least one intermediate point of attachment for a rein between the end eyelet and the chinband to allow a wielder of the rein to apply leverage through the sidepiece with the rein.

2. The bridle of claim 1, wherein the enhancing link comprises a series of interengaged links configured to provide flexibility to the enhancing link.

3. The bridle of claim 2, wherein the enhancing link includes at least five interengaged links associated therewith, the five interengaged links being configured to provide five intermediate points of attachment for the rein.

4. The bridle of claim 1, wherein the enhancing eyelet is substantially centered lengthwise along the enhancing link.

5. The bridle of claim 1, wherein the enhancing link is substantially flexible.

6. The bridle of claim 1, wherein the enhancing link is coupled to a chinband that is coupled to the chinband eyelet.

7. A bitless bridle for horses, comprising:

a pair of substantially rigid sidepieces, each including a shaft and at least five attachment eyelets associated therewith, the at least five attachment eyelets including:

a single, end eyelet extending longitudinally from a lowermost end of the sidepiece;

three eyelets grouped about an opposite end of the sidepiece in a cloverleaf configuration, one of the three eyelets being a chinband eyelet configured to be coupled to a chinband of the bridle; and an enhancing eyelet disposed intermediate the end eyelet and the chinband eyelet, the enhancing eyelet being configured to provide at least one intermediate point of attachment for a rein between the end eyelet and the chinband eyelet to allow a wielder of the rein to apply leverage through the sidepiece with the rein; and supporting headgear coupled to the pair of substantially rigid sidepieces and being configured to maintain the sidepieces in position on sides of the head of the horse; and an enhancing link coupled between the end eyelet and the chinband eyelet, wherein the enhancing link is formed of a plurality of chain links, one of which comprises the enhancing eyelet.

8. The bridle of claim 7, wherein the enhancing link includes at least five interengaged links associated therewith, the five interengaged links being configured to provide five intermediate points of attachment for the rein.

9. The bridle of claim 7, wherein the enhancing eyelet is substantially centered lengthwise along the enhancing link.

10. The bridle of claim 7, wherein the enhancing link is substantially flexible.

11. A method for directing or training a horse, comprising the steps of:

installing on a head of the horse a bitless bridle, the bitless bridle including:

a pair of substantially rigid sidepieces, each including a shaft and at least five attachment eyelets associated therewith, the at least five attachment eyelets including:

a single, end eyelet extending longitudinally from a lowermost end of the sidepiece;

three eyelets grouped about an opposite end of the sidepiece in a cloverleaf configuration, one of the three eyelets being a chinband eyelet configured to be coupled to a chinband of the bridle;

an enhancing link coupled between the end eyelet and the chinband eyelet, the enhancing link being formed of a plurality of chain links, one of which comprises the enhancing eyelet; and an enhancing eyelet disposed intermediate the end eyelet and the chinband; and selecting, based on a degree of leverage desired to be applied to the horse, one of: the end eyelet, the enhancing eyelet, the chinband eyelet and the chinband; and coupling a rein or a rope to and applying a force to the end eyelet, the enhancing eyelet, the chinband eyelet or the chinband, to provide direction to or to train the horse.

12. The method of claim 11, wherein the enhancing link includes at least five interengaged links associated therewith, the five interengaged links being configured to provide five intermediate points of attachment for the rein.

13. The method of claim 11, wherein the enhancing eyelet is substantially centered lengthwise along the enhancing link.

* * * * *